US012203348B2

(12) United States Patent
White et al.

(10) Patent No.: US 12,203,348 B2
(45) Date of Patent: Jan. 21, 2025

(54) SYSTEM AND METHOD FOR TURNING WELL OVER TO PRODUCTION

(71) Applicant: ConocoPhillips Company, Houston, TX (US)

(72) Inventors: Matthew L. White, Houston, TX (US); Jeffrey Spencer, Sunset, SC (US); Brian B. Hope, Houston, TX (US); Christopher J. Heikkinen, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 18/238,617

(22) Filed: Aug. 28, 2023

(65) Prior Publication Data

US 2024/0068333 A1 Feb. 29, 2024

Related U.S. Application Data

(60) Provisional application No. 63/401,403, filed on Aug. 26, 2022.

(51) Int. Cl.

| | |
|---|---|
| ***E21B 43/26*** | (2006.01) |
| ***E21B 43/10*** | (2006.01) |
| ***E21B 43/12*** | (2006.01) |

(52) U.S. Cl.

CPC ..... *E21B 43/10* (2013.01); *E21B 43/123* (2013.01); *E21B 43/26* (2013.01)

(58) Field of Classification Search

CPC ..... E21B 10/32; E21B 10/322; E21B 10/325; E21B 10/327; E21B 17/1014

See application file for complete search history.

(56) References Cited

U.S. PATENT DOCUMENTS

| | | | | |
|---|---|---|---|---|
| 5,255,741 | A * | 10/1993 | Alexander | E21B 43/04 166/278 |
| 5,320,178 | A * | 6/1994 | Cornette | E21B 43/08 166/278 |
| 5,662,170 | A * | 9/1997 | Donovan | E21B 43/045 166/278 |
| 5,749,419 | A * | 5/1998 | Coronado | E21B 33/1294 166/123 |
| 5,842,528 | A * | 12/1998 | Johnson | E21B 49/003 166/278 |
| 7,108,083 | B2 * | 9/2006 | Simonds | E21B 43/105 166/227 |
| 9,863,213 | B1 * | 1/2018 | Kellam | E21B 34/105 |
| 10,626,701 | B1 | 4/2020 | Kellam et al. | |
| 2002/0117301 | A1 | 8/2002 | Womble | |

(Continued)

OTHER PUBLICATIONS

International Search Report and The Written Opinion of The International Searching Authority for International Application No. PCT/US2023/031225 dated Nov. 16, 2023 (11 pages).

(Continued)

*Primary Examiner* — Kipp C Wallace
(74) *Attorney, Agent, or Firm* — Polsinelli PC

(57) ABSTRACT

A system and method for turning a well over to production. The method may include drilling a wellbore using a drillstring, casing the wellbore, fracturing a reservoir, drilling the wellbore to a plug back total depth using the drillstring to clean out the wellbore, and converting the drillstring from a drilling mode to a production mode.

8 Claims, 21 Drawing Sheets

(56) References Cited

U.S. PATENT DOCUMENTS

| | | | | |
|---|---|---|---|---|
| 2008/0179065 | A1* | 7/2008 | Vincent | E21B 33/134 166/387 |
| 2008/0210422 | A1 | 9/2008 | Clark et al. | |
| 2009/0145660 | A1 | 6/2009 | Johnson et al. | |
| 2012/0175108 | A1* | 7/2012 | Foubister | E21B 33/1294 166/126 |
| 2012/0175113 | A1* | 7/2012 | Bullock | E21B 21/082 166/278 |
| 2014/0238668 | A1 | 8/2014 | Bittleston et al. | |
| 2016/0215605 | A1 | 7/2016 | Fontenot et al. | |
| 2019/0003286 | A1* | 1/2019 | Bigrigg | E21B 29/00 |
| 2020/0291756 | A1* | 9/2020 | Stautzenberger | E21B 33/10 |
| 2020/0318451 | A1* | 10/2020 | von Gynz-Rekowski | E21B 29/06 |
| 2021/0372229 | A1* | 12/2021 | Palmer | E21B 34/14 |

OTHER PUBLICATIONS

Donald F.B. Jackson et al., Investigation of Liquid Loading in Tight Gas Horizontal Wells With a Transient Multiphase Flow Simulator, Canadian Unconventional Resources Conference held in Calgary, Alberta, Canada, Nov. 15-17, 2011.

Steven A. Pohler et al., Annular Velocity Enhancement with Gas Lift as a Deliquification Method for Tight Gas Wells with Long Completion Intervals, SPE Unconventional Gas Conference held in Pittsburgh, Pennsylvania, USA, Feb. 23-25, 2010.

* cited by examiner

SECTION A-A

SECTION A-A

SECTION A-A

SYSTEM AND METHOD FOR TURNING WELL OVER TO PRODUCTION

CROSS-REFERENCE TO RELATED APPLICATIONS

The present application claims priority to U.S. Provisional Application No. 63/401,403, entitled "System and Method for Turning Well Over to Production" and filed on Aug. 26, 2022, which is specifically incorporated by reference in its entirety herein.

FIELD

The present disclosure relates to a method and system for drilling wellbores and more particularly to turning over a well to production by converting the drillstring to a production string.

BACKGROUND

After drilling to clean out a wellbore to plug back total depth (i.e., the depth of a well to the top of the deepest permanent plug), conventional methods and systems require removing both a bottomhole assembly and drillstring from the wellbore and inserting a production string and production bottomhole assembly into the wellbore to turn over a well to production. This is costly and inefficient. Accordingly, there is a need for an improved system and method to turn over a well to production that is efficient and cost effective.

SUMMARY

Implementations described and claimed herein provide a system and method to turn a well over to production without requiring removal of the entire drillstring and bottomhole assembly and insertion of a production string and production bottomhole assembly.

In one implementation, a method may include drilling a wellbore. The method may also include casing the wellbore. The method may further include fracturing a subterranean reservoir. The method may further include removing a portion of the drillstring. The method may further include converting the drillstring disposed in the wellbore to a production mode. The method may further include drilling the wellbore to a plug back total depth using the drillstring. The method may further include converting the drillstring to a production mode.

In another implementation, a system may include a drillstring capable of being transitioned between drilling and production modes. When the drillstring is in the drilling mode, the drillstring includes a drillout bottomhole assembly, first and second gas injection control nipples, first and second profile nipples, a backpressure valve, a workstring, and first and second workstring crossovers. When the drillstring is in the production mode, the drillstring includes the first and second gas injection control nipples, one of the first and second profile nipples, the backpressure valve, a reverse flow check and orifice valve disposed at the first gas injection control nipple, and a packer and crossover tool.

In another implementation, a system may include a drillstring capable of being transitioned between drill and production modes. When the drillstring is in the drilling mode, the drillstring includes a drillout bottomhole assembly, first and second gas injection control nipples, first and second profile nipples, a backpressure valve, a workstring, and first and second workstring crossovers. When the drillstring is in the production mode, the drillstring includes the first and second gas injection control nipples, one of the first and second profile nipples, the backpressure valve, a reverse flow check and orifice valve disposed at the first gas injection control nipple, and a gas lift mandrel.

The foregoing is intended to be illustrative and is not meant in a limiting sense. Many features of the implementations may be employed with or without reference to other features of any of the implementations. Additional aspects, advantages, and/or utilities of the present disclosure will be set forth in part in the description that follows and, in part, will be apparent from the description, or may be learned by practice of the present disclosure.

BRIEF DESCRIPTION OF THE DRAWINGS

The foregoing summary, as well as the following detailed description, will be better understood when read in conjunction with the appended drawings. For the purpose of illustration, there is shown in the drawings certain implementations of the present disclosure. It should be understood, however, that the present disclosure is not limited to the precise implementations and features shown. The accompanying drawings, which are incorporated in and constitute a part of this specification, illustrate an implementation of apparatuses consistent with the present disclosure and, together with the description, serve to explain advantages and principles consistent with the present disclosure.

DETAILED DESCRIPTION

Figure 1:
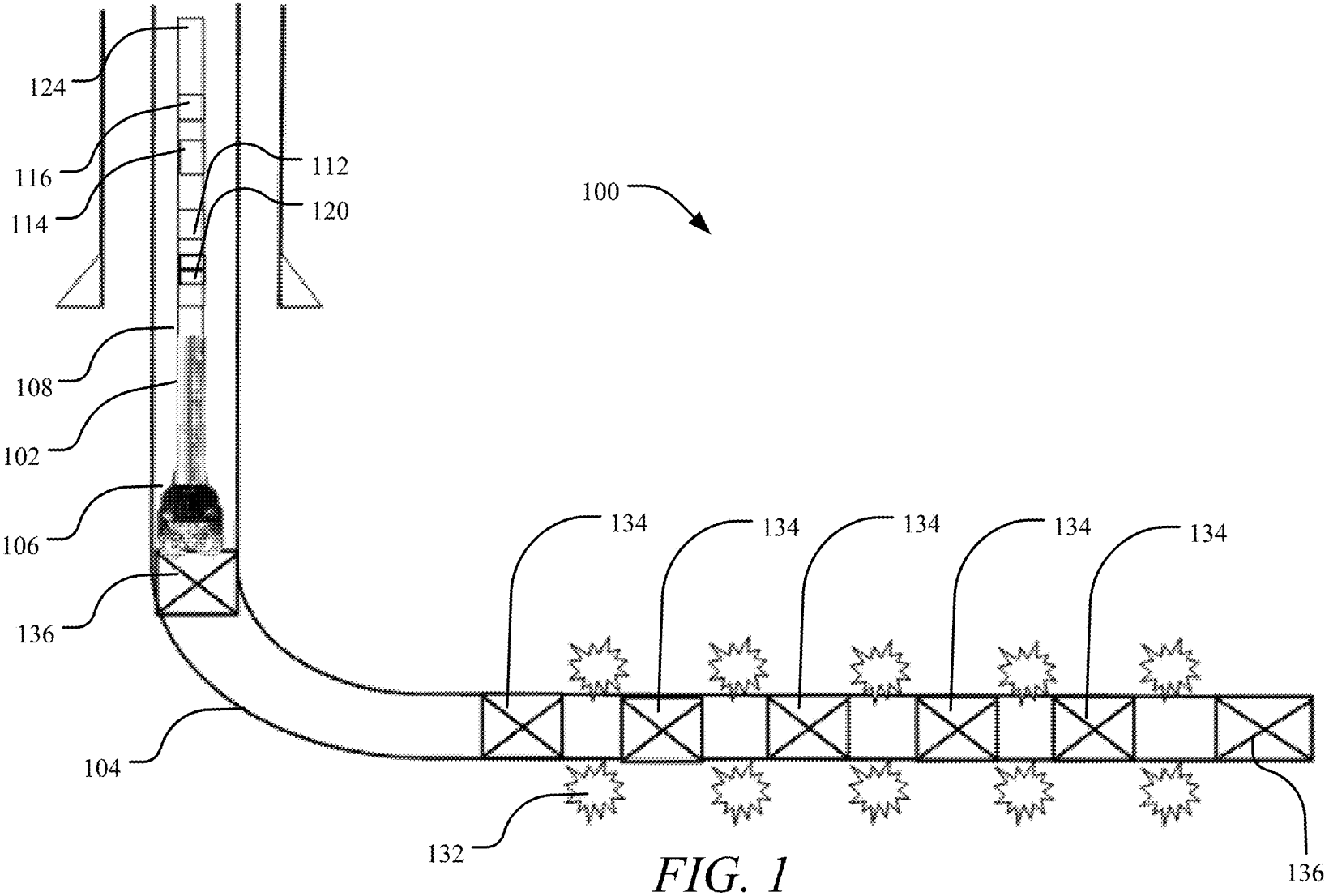
FIG. 1 is a diagram illustrating an example system with a drillstring in a drilling mode.

The following detailed description references the accompanying drawing that illustrates various implementations of the present disclosure. The illustration and description are intended to describe aspects and implementations of the present disclosure in sufficient detail to enable those skilled in the art to practice the present disclosure. Other components can be utilized and changes can be made without deviating from the scope of the present disclosure. The following detailed description is, therefore, not to be taken in a limiting sense. The scope of the present disclosure is defined only by the appended claims, along with the full scope of equivalents to which such claims are entitled.

The phraseology and terminology employed herein are for the purpose of description and should not be regarded as limiting. For example, the use of a singular term, such as, "a" is not intended as limiting of the number of items. Also, the use of relational terms such as, but not limited to, "top," "bottom," "left," "right," "upper," "lower," "down," "up," and "side," are used in the description for clarity in specific reference to the figures and are not intended to limit the scope of the present disclosure or the appended claims. The term "automatic," "automatically," or any variation thereof is used in the description to describe performing a subsequent action without any assistance, interference, and/or input from a human. Further, it should be understood that any one of the features of the present disclosure may be used separately or in combination with other features. Other systems, methods, features, and advantages of the present disclosure will be, or become, apparent to one with skill in the art upon examination of the figures and the detailed description. It is intended that all such additional systems, methods, features, and advantages be included within this description, be within the scope of the present disclosure, and be protected by the accompanying claims.

The present disclosure is described below with reference to operational illustrations of methods and devices. It is understood that the specific order or hierarchy of steps in the methods disclosed are instances of example approaches. Based upon design preferences, it is understood that the specific order or hierarchy of steps in the method can be rearranged while remaining within the disclosed subject matter. The accompanying method claims present elements of various steps in a sample order and are not necessarily meant to be limited to the specific order or hierarchy presented.

Further, as the present disclosure is susceptible to implementations of many different forms, it is intended that the present disclosure be considered as an example of the principles of the present disclosure and not intended to limit the present disclosure to the specific implementations shown and described. Any one of the features of the present disclosure may be used separately or in combination with any other feature. References to the terms "implementation," "implementations," and/or the like in the description mean that the feature and/or features being referred to are included in, at least, one aspect of the description. Separate references to the terms "implementation," "implementations," and/or the like in the description do not necessarily refer to the same implementation and are also not mutually exclusive unless so stated and/or except as will be readily apparent to those skilled in the art from the description. For example, a feature, structure, process, step, action, or the like described in one implementation may also be included in other implementations but is not necessarily included. Thus, the present disclosure may include a variety of combinations and/or integrations of the implementations described herein. Additionally, all aspects of the present disclosure, as described herein, are not essential for its practice. Likewise, other systems, methods, features, and advantages of the present disclosure will be, or become, apparent to one with skill in the art upon examination of the figures and the description. It is intended that all such additional systems, methods, features, and advantages be included within this description, be within the scope of the present disclosure, and be encompassed by the claims.

The term "coupled" is defined as connected, whether directly or indirectly through intervening components, and is not necessarily limited to physical connections. The connection can be such that the objects are permanently connected or releasably connected. The terms "comprising," "including" and "having" are used interchangeably in this disclosure. The terms "comprising," "including" and "having" mean to include, but not necessarily be limited to the things so described. The term "real-time" or "real time" means substantially instantaneously.

Lastly, the terms "or" and "and/or," as used herein, are to be interpreted as inclusive or meaning any one or any combination. Therefore, "A, B or C" or "A, B and/or C" mean any of the following: "A," "B" or "C"; "A and B"; "A and C"; "B and C"; "A, B and C." An exception to this definition will occur only when a combination of elements, functions, steps or acts are in some way inherently mutually exclusive.

Turning to FIGS. 1-5, a system 100 is illustrated that includes a drillstring 102 extending into a wellbore 104. The wellbore 104 extends into the ground and is formed via a drilling process, such as, for example, using the drillstring 102. In some examples, a depth of the wellbore 104 can range from a few feet to over a mile into the ground and can extend in one or more directions. The drillstring 102 may be capable of being transitioned between drilling and production modes. When the drillstring 102 is in drilling mode, the drillstring 102 includes a drillout bottomhole assembly (BHA) 106 positioned at a bottom of the drillstring 102, first 108 and second 110 workstring crossovers, first 112 and second 114 gas injection control nipples, first 116 and second 118 profile nipples, a backpressure valve (BPV) 120, a workstring 122, and production tubing 124. When the drillstring 102 is in the production mode, the drillstring 102 includes the first 112 and second 114 gas injection control nipples, the first profile nipple 116, the BPV 120, production tubing 124, a reverse flow check and orifice valve 126 disposed at the first gas injection control nipple 112, and a packer and crossover tool 128. Thus, when the drillstring 102 is converted from drill mode to production mode, the BHA, first 108 and second 110 workstring crossovers, the second profile nipple 118, and the workstring 122 are removed from the drillstring 102, and the reverse flow check and orifice valve 126 and a packer and crossover tool 128 are added to the drillstring 102.

The BHA 106 can include a plurality of components. In one implementation, the BHA 106 is a sacrificial BHA. In other words, the BHA remains in the wellbore 104 during production and will not be retrieved. Thus, the BHA 106 would only include the minimum amount of equipment to perform drilling operations, such as, for example, a mud motor and a drill bit. However, it is foreseen that the BHA 106 may include fewer or additional components. The drillstring 102 extends into the wellbore 104 so that the drill bit of the BHA 106 is used to drill and cleanout completion equipment such as frac plugs, etc. to plug back total depth inside the pre-existing casing.

The first 108 and second 110 crossovers are used to couple to different sized components. The first crossover 108 couples the BHA 106 to the drillstring 102, and the second crossover 110 is used to couple the workstring 122 to the production tubing 124. In one implementation, the first crossover 108 is coupled to the BHA 106 using a hydraulic bit release sub with profile. The hydraulic bit release sub with profile is a disconnect device that separates using a drop ball 140. Once the drop ball 140 is pumped down to the hydraulic bit release sub, pressure is increased to a predetermined release pressure to separate the hydraulic bit release sub, thereby releasing the BHA 106 from the drillstring 102.

The first 112 and second 114 gas injection control nipples are seating nipples with a reduced bore compared to the inner diameter of the production tubing 124 to prevent gas injection control tools from passing through. For example, the first 112 gas injection control nipple is used for seating the reverse flow check and orifice valve 126 in the production tubing 124. The second 114 gas injection control nipple can be used for contingency valves, such as, for example, a second reverse flow check and orifice valve.

The first 116 and second 118 profile nipples are internally profiled subs that are typically run below retrievable or permanent packers. The first 116 and second 118 profile nipples allow for positioning various flow control devices in the drillstring 102.

The backpressure valve (BPV) 120 is a plug that is used to facilitate the installation and removal of wellhead components. The BPV can be a one-way (i.e., a check valve) or two-way (i.e., a solid valve) valve. The BPV isolates the production tubing 124 by holding pressure from below yet still enabling fluids to be pumped from above, as may be required for deployment of well-control devices.

The workstring 122 is drill pipe or tubing that is used in well workover operations or abandonment operations to perform specific downhole tasks, such as, for example, running squeeze cementing tools and stimulation packers, as well as performing stimulation, testing, cementing, wellbore cleanout, etc. In one implementation, the workstring is composed of PH-6 tubing connections. PH-6 tubing connections are tubing connections with a torque shoulder and are used with workstrings when medium to high-torque is required.

The production tubing 124 is a wellbore tubular used to produce reservoir fluids. Production tubing is assembled with other completion components discussed herein to make up the drillstring 102. The production tubing 124 is selected to be compatible with the wellbore geometry, reservoir production characteristics, the reservoir fluids, etc. In one implementation, the production tubing 124 is assembled using torque rings.

The reverse flow check and orifice valve 126 incorporates an orifice or flow-restriction device to control fluid flow, while also protecting from backflow. The reverse flow check and orifice valve 126 is disposed in the first gas injection control nipple 112 when the drillstring 102 is in production mode.

The packer and crossover tool 128 is used to isolate the injection gas from production retrieved from the reservoir. As illustrated by the arrows in FIG. 5, injection gas is pumped into the wellbore 104. The packer and crossover tool 128 receives the injection gas above the packer and crossover tool 128 and directs the injection gas into the production tubing 124 below the packer and crossover tool 128. Below the packer and crossover tool 128, the production is received and transferred into the production tubing 124 above the packer and crossover tool 128 to return to the surface. Turning to FIGS. 8-20, the packer and crossover tool 128 includes a bypass access mandrel assembly 142, an on-off tool 144, a packer 146, and a pup joint 148.

The bypass access mandrel assembly 142 includes a slotted nipple 150, a smooth bore seat nipple assembly 152, a center-set mandrel 154, a lock assembly 156, a bottom backing assembly 158, an RN Nipple 160, a check valve lock assembly 162, a packer 164, a pipe 166, and a bypass access mandrel 168. In one implementation, the bypass access mandrel assembly 142 is the bypass access mandrel disclosed in U.S. Pat. No. 7,766,085, which is incorporated herein by reference.

Figure 13:
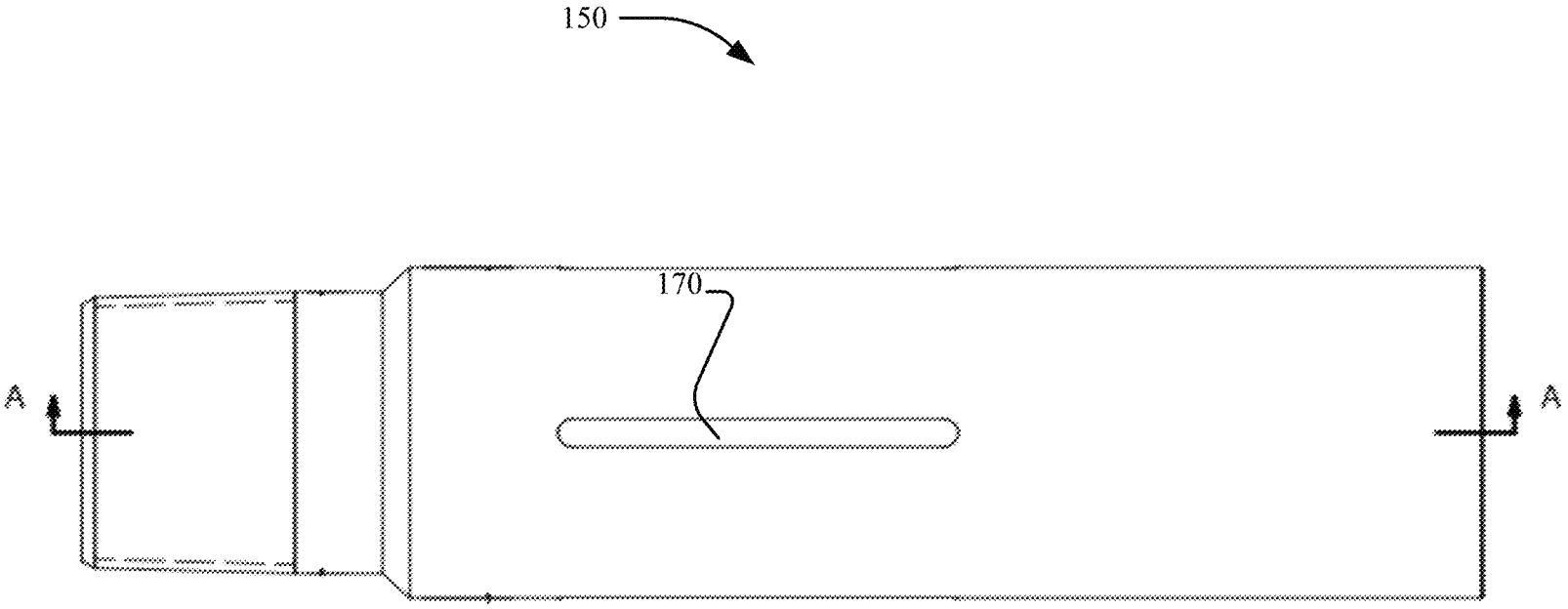
FIG. 13 is a front view of an example slotted nipple.
Figure 14:
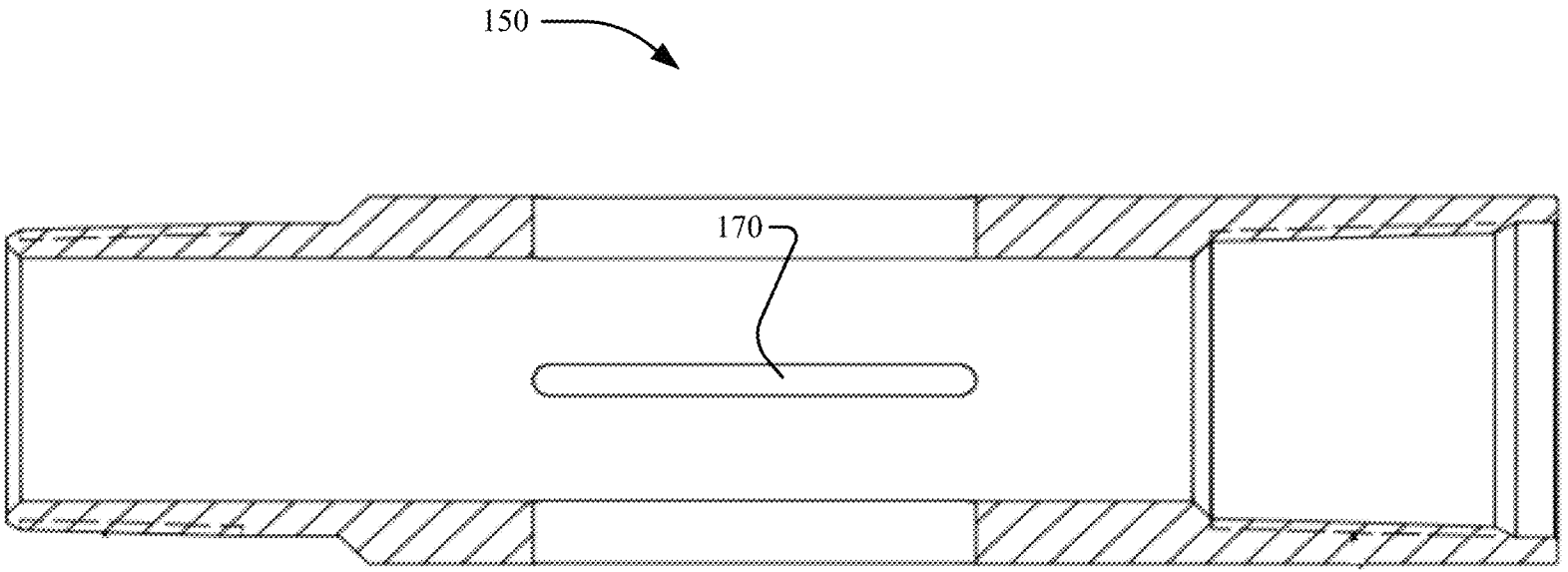
FIG. 14 is a section view of the slotted nipple of FIG. 13.

The slotted nipple 150 is disposed between the packer 164 and the smooth bore seat nipple assembly 152. Turning to FIGS. 13 and 14, the slotted nipple 150 includes a plurality of slots 170 and opposing threaded ends. Although four slots 170 are shown, the disclosure is not limited as such and any suitable number of slots 170 may be used. The slotted nipple 150 may be composed of L80 steel. However, the disclosure is not limited as such, and any suitable material may be used.

Figure 17:
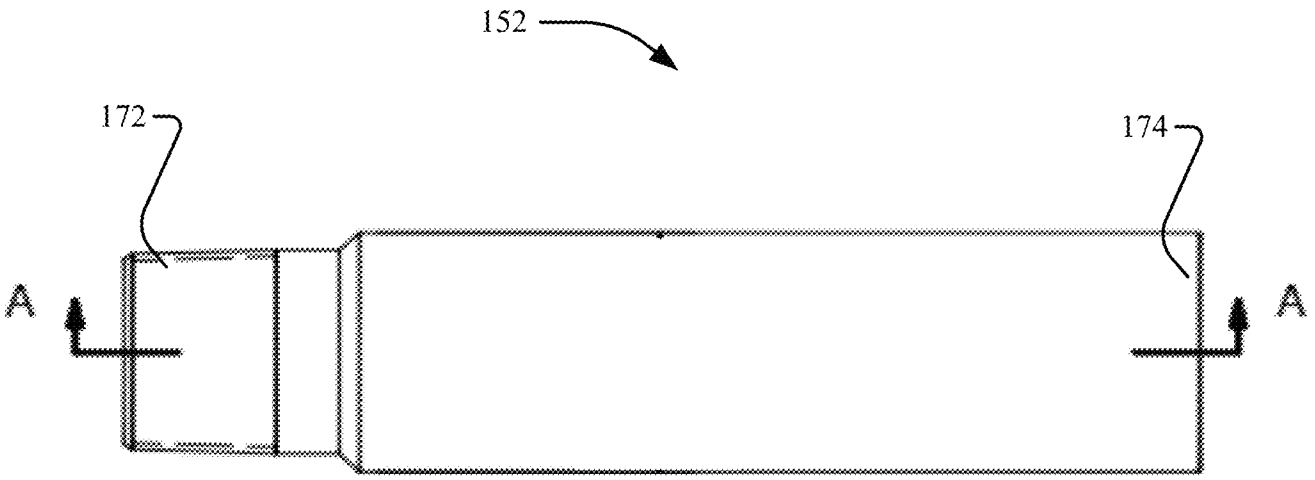
FIG. 17 is a front view of an example smooth bore nipple.
Figure 18:
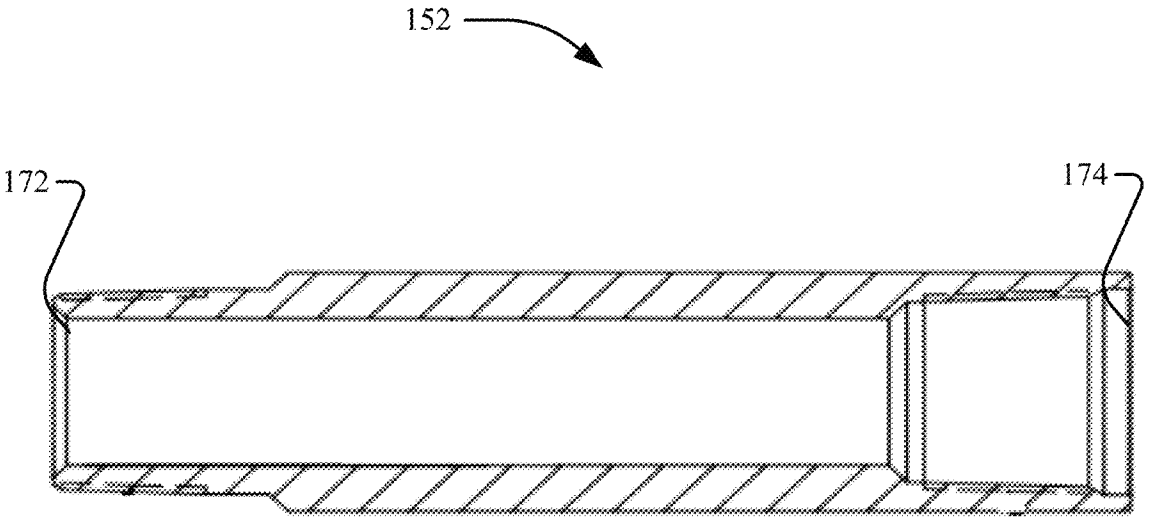
FIG. 18 is a section view of the smooth bore nipple of FIG. 17.

The smooth bore seat nipple assembly 152 is disposed between the slotted nipple 150 and the RN Nipple 160. Turning to FIGS. 17 and 18, the smooth bore seat nipple assembly 152 includes first 172 and second 174 threaded ends. The smooth bore seat nipple assembly 152 may be composed of L80 steel. However, the disclosure is not limited as such, and any suitable material may be used.

The center-set mandrel 154 is coupled to the packer 164. In one implementation, the center-set mandrel has an outside diameter of about 4½ inches.

Figure 15:
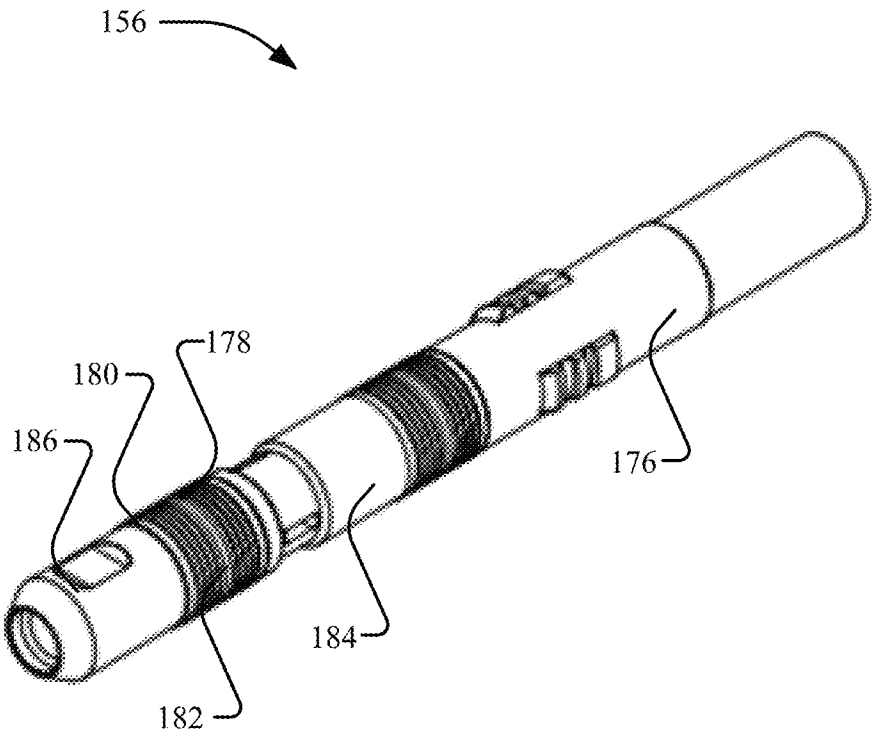
FIG. 15 is a perspective view of an example lock assembly.
Figure 16:
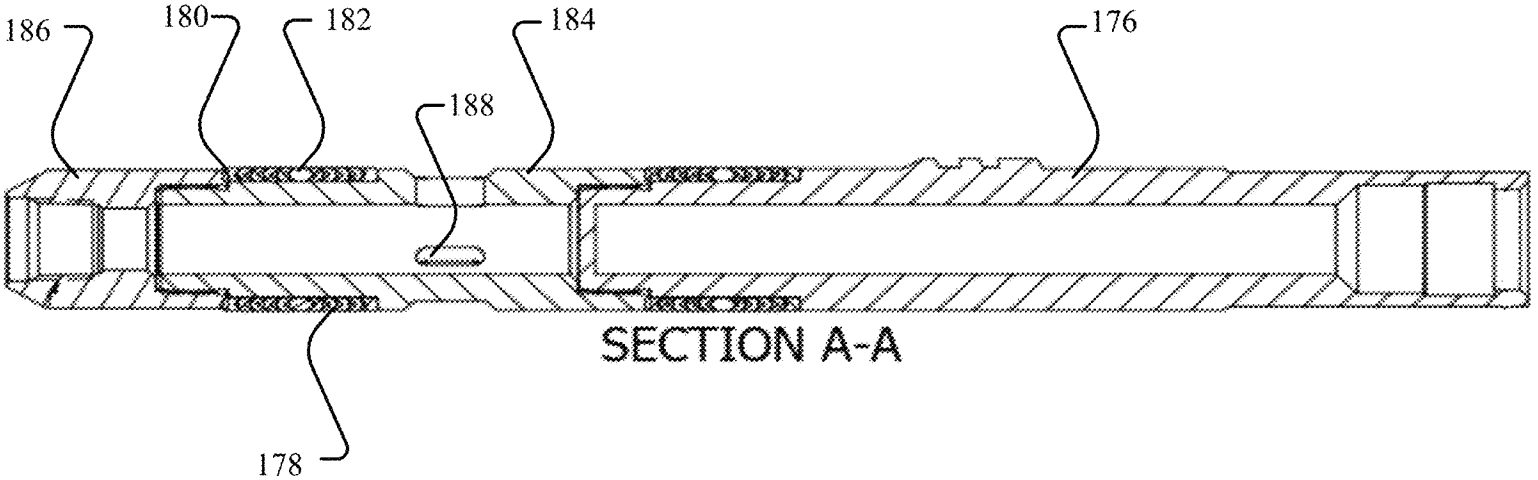
FIG. 16 is a section view of the lock assembly of FIG. 15.

The lock assembly 156 is disposed within the center-set mandrel 154. Turning to FIGS. 15 and 16, the lock assembly 156 includes a lock portion 176, v-packing 178, backup rings 180, an adaptor ring 182, a body portion 184, a nut portion 186, and a plurality of slots 188. Although four slots 188 are shown, the disclosure is not limited as such and any suitable number of slots 188 may be used. The lock portion 176, backup rings 180, adaptor ring 182, body portion 184, and nut portion 186 may be composed of 4140 HF steel. The v-packing 178 may be composed of a composite fiber. However, the disclosure is not limited to these materials, and any suitable materials may be used.

Figure 19:
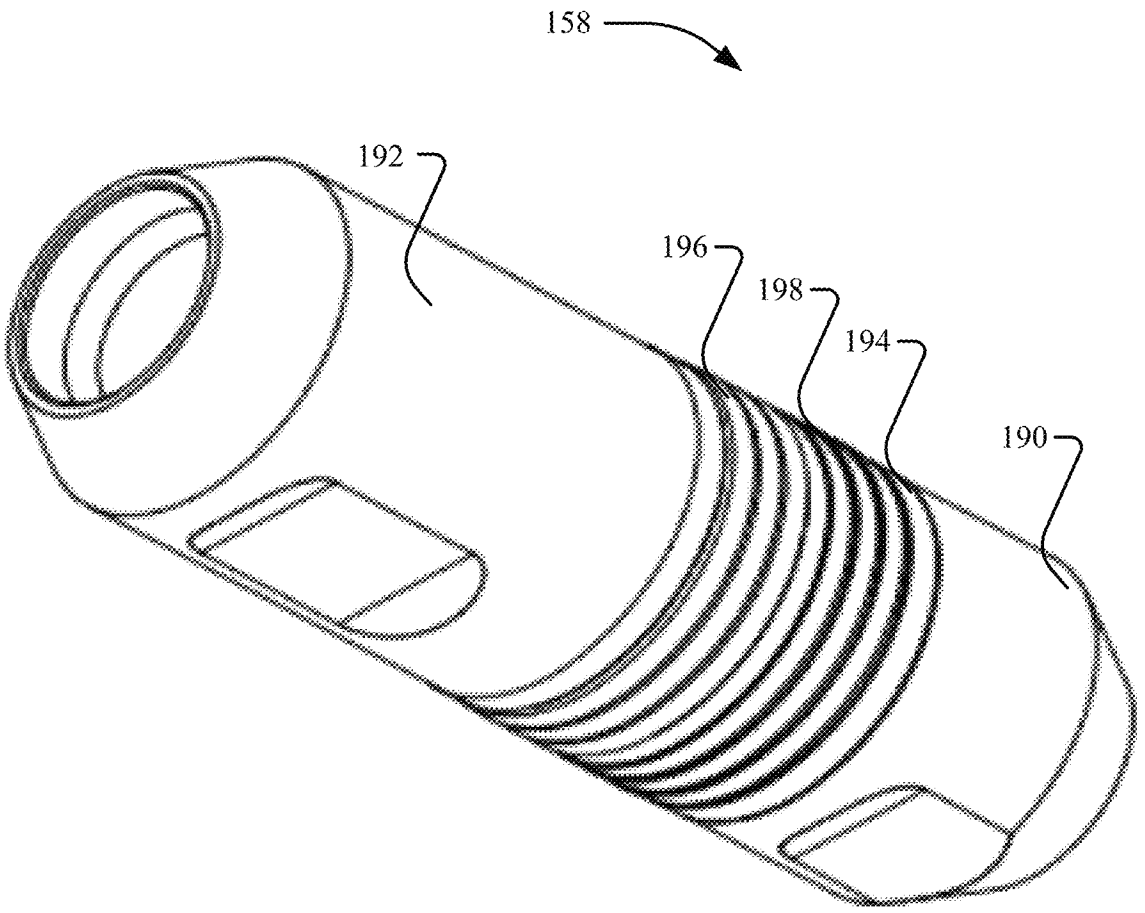
FIG. 19 is a perspective view of an example bottom packing assembly.
Figure 20:
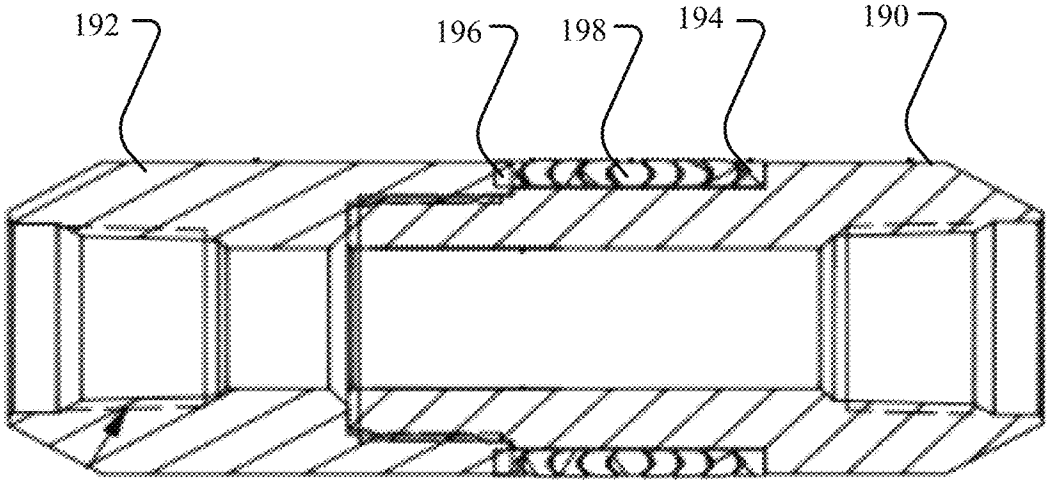
FIG. 20 is a section view of the bottom packing assembly of FIG. 19.

The bottom backing assembly 158 is disposed within the smooth bore seat nipple assembly 152. Turning to FIGS. 19 and 20, the bottom backing assembly 158 includes a mandrel portion 190, a nut portion 192, a backup ring 194, v-cup 196, and an adapter ring 198. The mandrel portion 190, nut portion 192, backup ring 194, and adapter ring 198 may be composed of 4140 HF steel. The v-cup 196 may be composed of a composite fiber. However, the disclosure is not limited to these materials, and any suitable material may be used. In one implementation, the inner diameter of the bottom backing assembly 158 is about 1 inch.

RN Nipple 160 is disposed adjacent to the smooth bore seat nipple assembly 152. The check valve lock assembly 162 is disposed within the RN Nipple 160. The packer 164 is disposed between the slotted nipple 150 and the center-set mandrel 154. A pipe 166 is disposed within the packer 164. In one implementation, the pipe 166 is a 1-inch schedule 80 pipe.

The bypass access mandrel 168 is disposed within the center-set mandrel 154. The bypass access mandrel 168 includes a pin adapter portion 200, a box adapter portion 202, a housing portion 204 disposed between the pin adapter portion 200 and the box adapter portion 202, and a sealbore portion 206 disposed within the housing portion 204. The bypass access mandrel 168 includes one or more openings 208 extending through the housing portion 204 to the sealbore portion 206. In one implementation the bypass access mandrel 168 is composed of 4130 QT steel. However, the disclosure is not limited as such, and any suitable material may be used.

In one implementation, the on-off tool 144 includes a bored out inner diameter of about 2.441 inches. However, the disclosure is not limited as such, and any suitable on-off tool and inner diameter may be used.

The pup joint 148 is disposed between the telescoping swivel joint 138 and the bypass access mandrel assembly 142. The pup joint 148 may be a 2⅞ Inch, 6.5 LB/Ft sized pup joint and may be composed of L80 steel. In one implementation, the outside diameter is about 3.668 inches, the inner diameter is about 2.441 inches, and the length is about 6 feet. However, the disclosure is not limited as such, and any suitable pup joint may be used.

Figure 5:
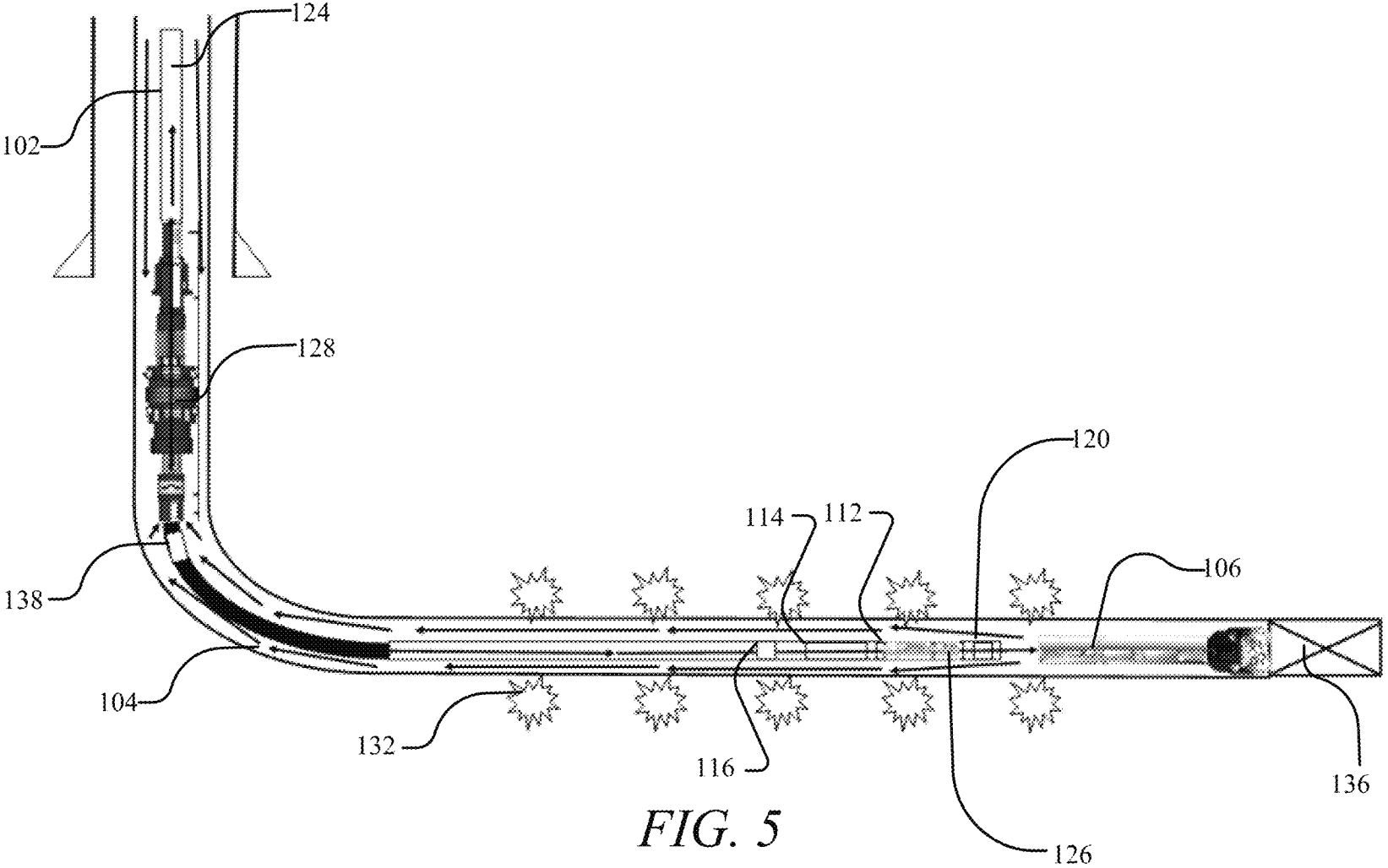
FIG. 5 is a diagram illustrating an example system with a drillstring being in a production mode.
Figure 6:
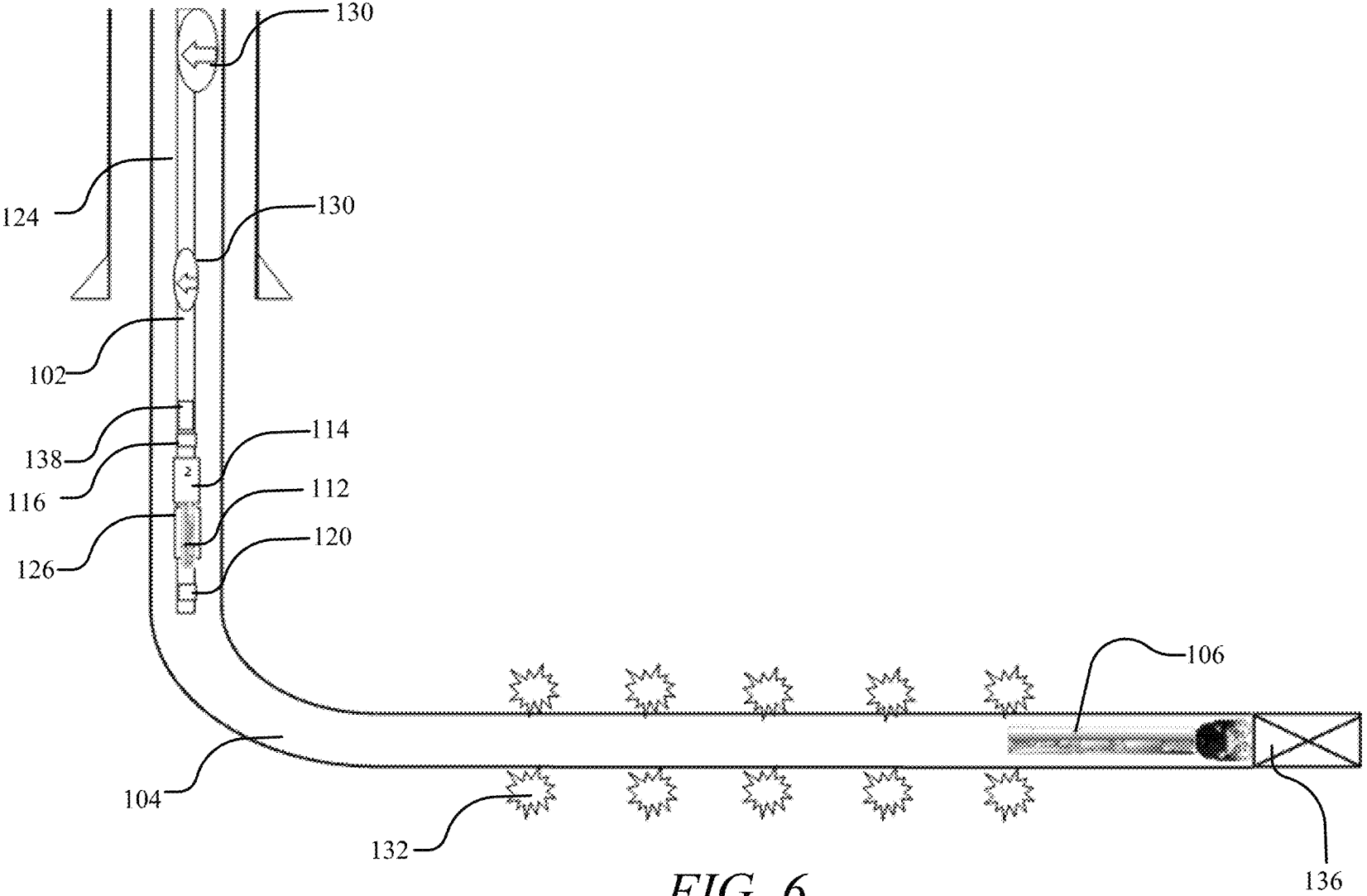
FIG. 6 is a diagram illustrating an example system with a drillstring being converted from a drilling mode to a production mode in accordance with another implementation.
Figure 7:
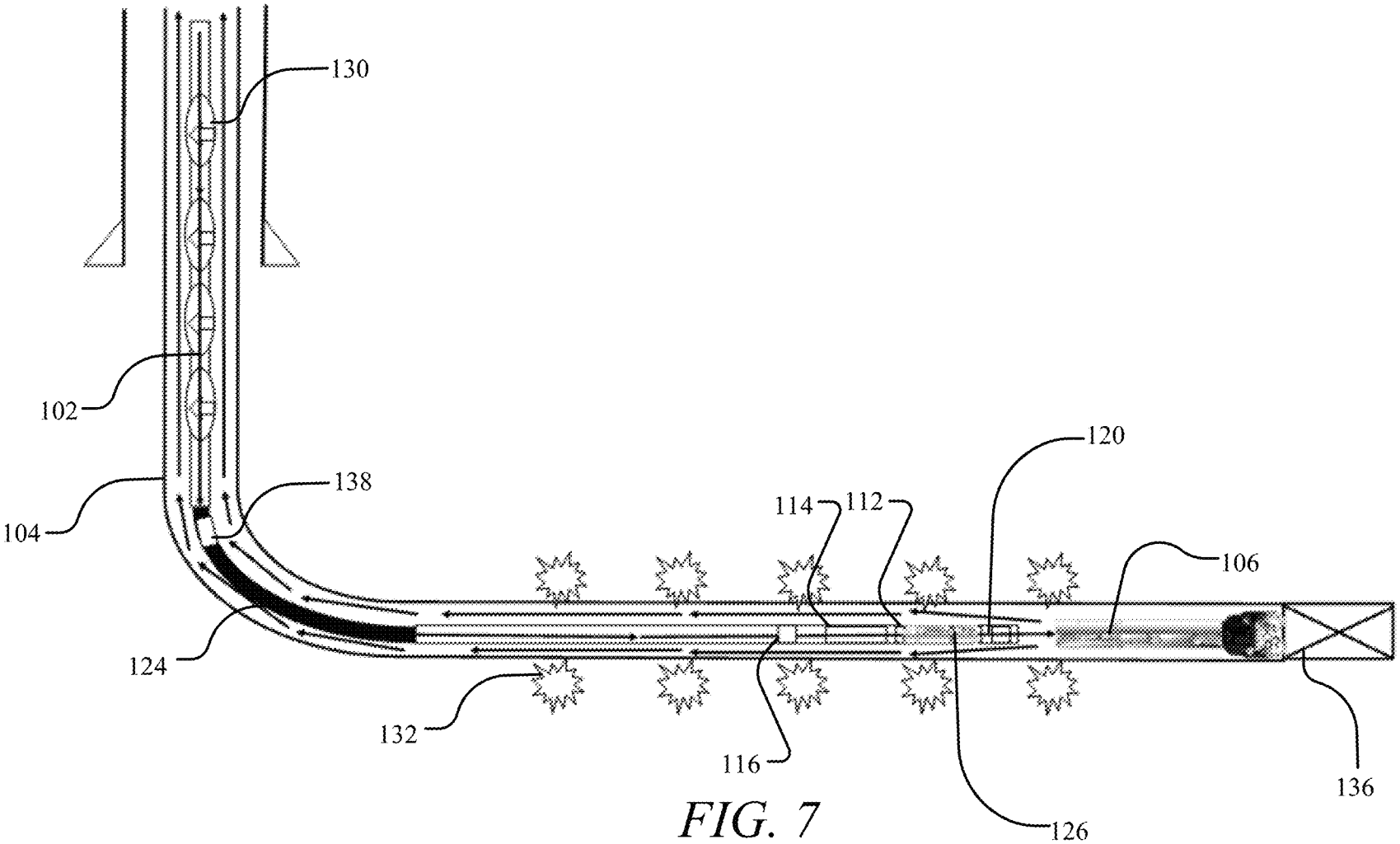
FIG. 7 is a diagram illustrating an example system with a drillstring being in a production mode in accordance with another implementation.
Figure 8:
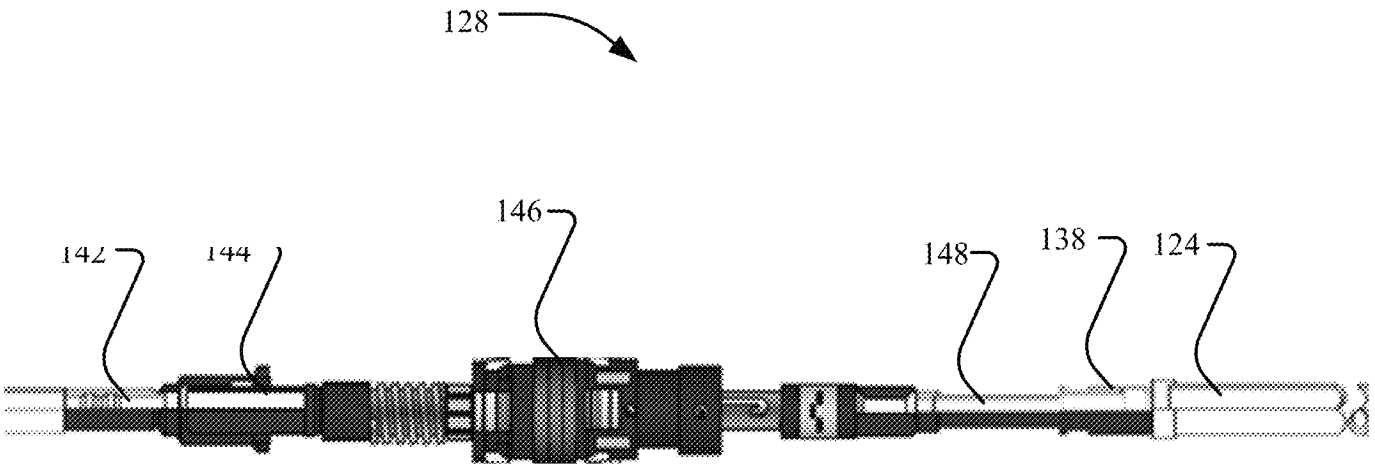
FIG. 8 is a front view of an example packer and crossover tool.
Figure 9:
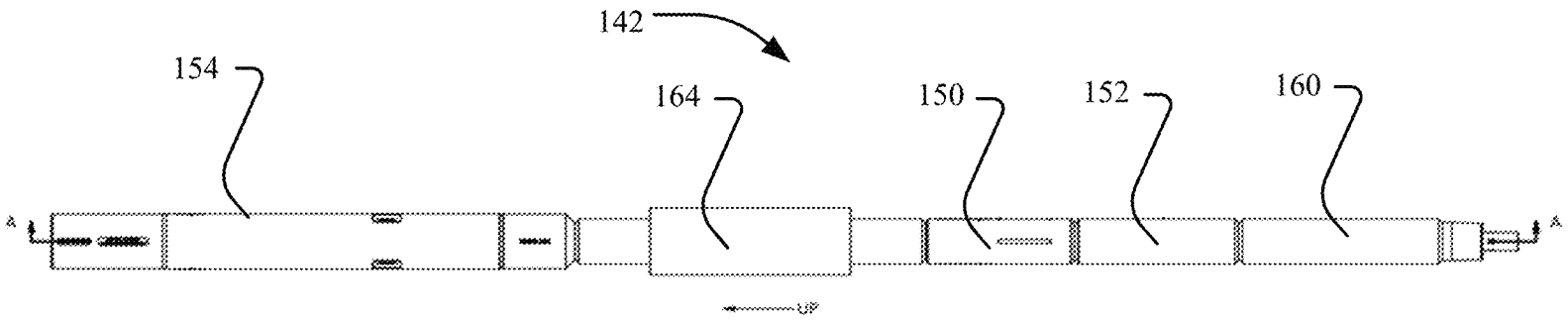
FIG. 9 is a front view of an example bypass access mandrel and crossover assembly.
Figure 10:
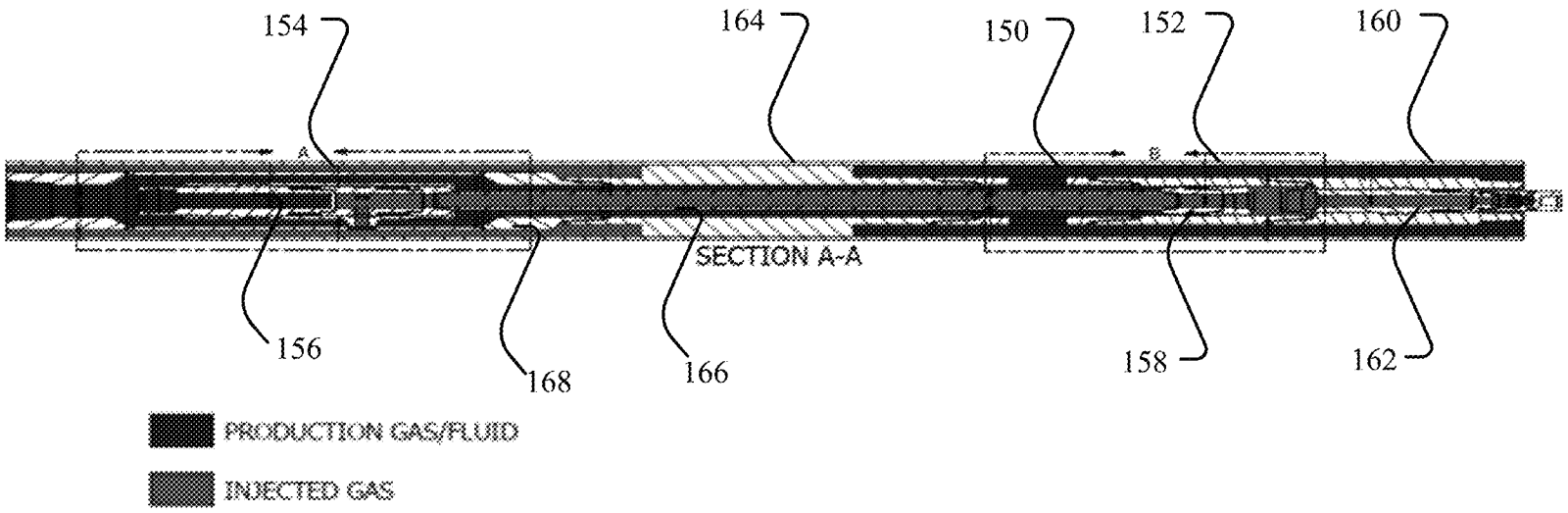
FIG. 10 is a section view of the bypass access mandrel and crossover assembly of FIG. 9.
Figure 11:
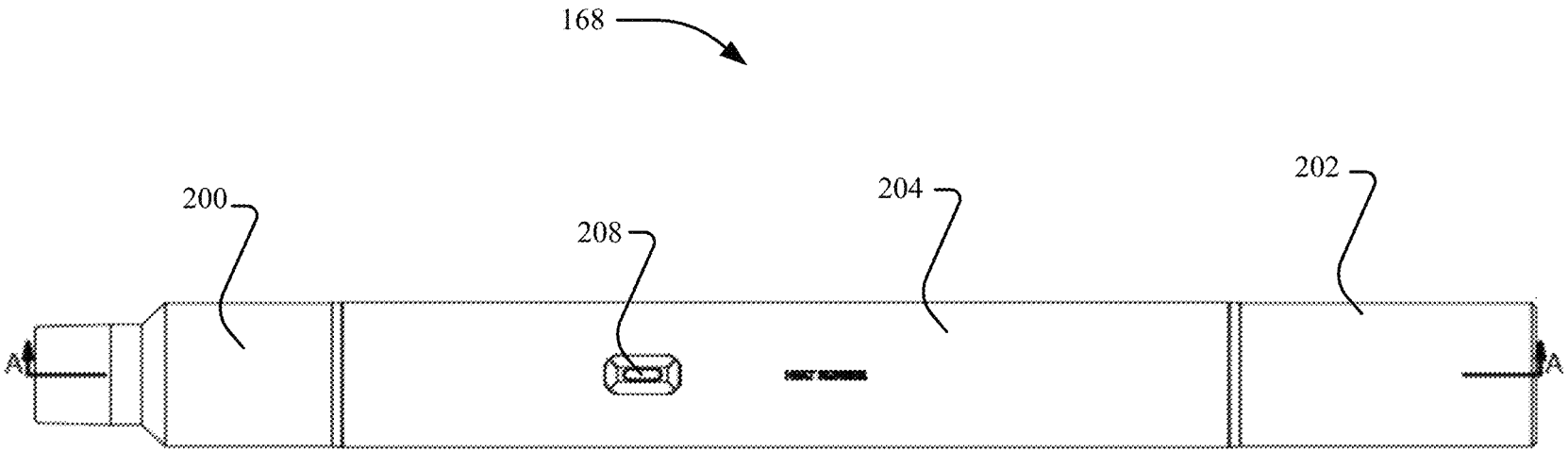
FIG. 11 is a front view of an example bypass access mandrel.
Figure 12:
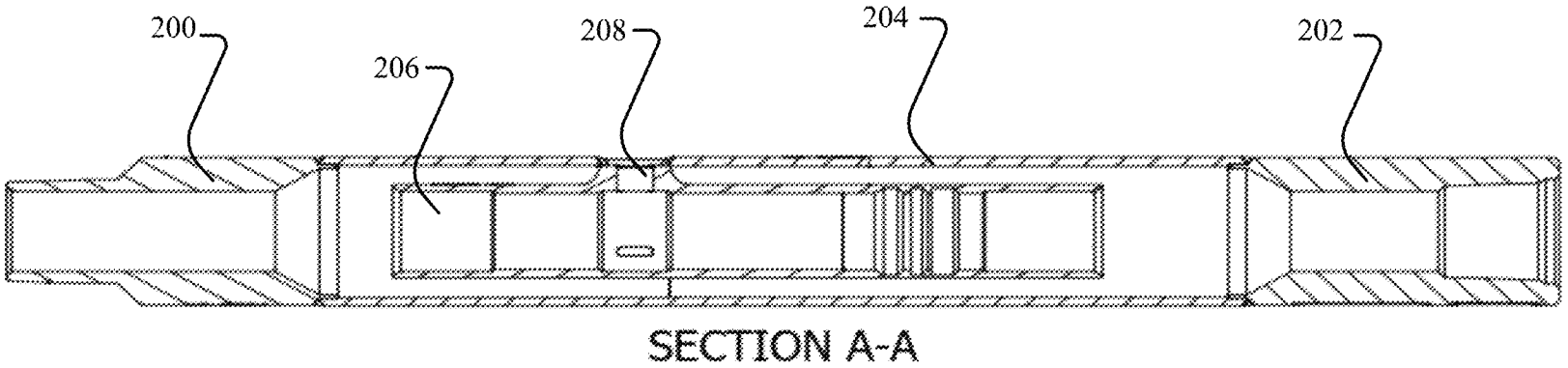
FIG. 12 is a section view of the bypass access mandrel of FIG. 11.

Turning to FIGS. 6 and 7, in accordance with another implementation, when the drillstring 102 is in production mode, the drillstring 102 includes one or more gas lift mandrels 130 instead of the packer and crossover tool 128. Other than the substitution of the one or more gas lift mandrels 130 for the packer and crossover tool 128, the implementation illustrated in FIGS. 1-5 and the implementation illustrated in FIGS. 6 and 7 are substantially the same.

The gas lift mandrels 130 are part of a gas lift artificial lift system. The gas lift mandrels 130 are adapted to receive gas lift valves. The position or depth of the gas lift valves is crucial to the efficient operation of the entire system. As illustrated by the arrows in FIG. 7, the gas lift valves in the gas lift mandrels 130 allow for injection gas to be conveyed down the production tubing 124 to allow for extraction of the production from the reservoir, which flows outside the production tubing 124.

In one implementation where the wellbore 104 includes vertical and horizontal portions, a telescoping swivel joint 138 is disposed in an area that the wellbore 104 is transitioning from the vertical portion to the horizontal portion, as illustrated in FIGS. 5 and 7. In one implementation, the telescoping swivel joint 138 is a 2⅞ Inch and 6.5 LB/Ft sized telescoping swivel joint. However, the implementation is not limited as such, and any suitable telescoping swivel joint may be used.

Figure 21:
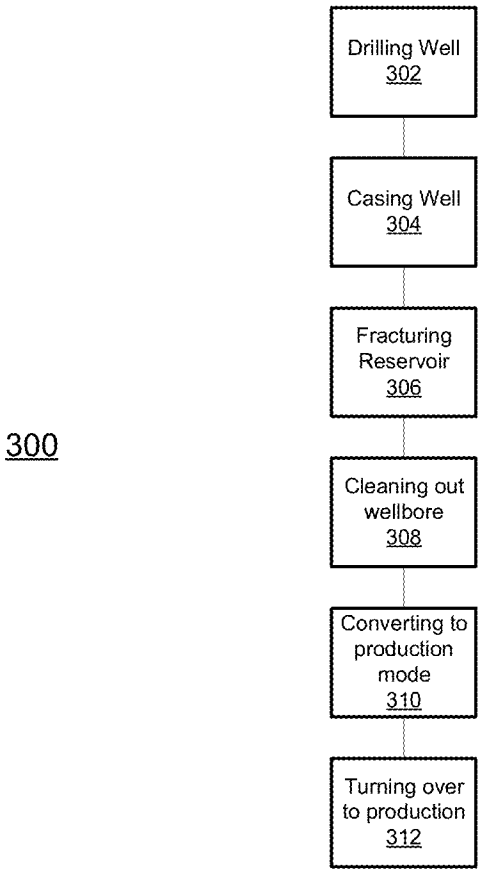
FIG. 21 is a flow chart of an example method for turning a well over to production.

Turning to FIG. 21, a method 300 for turning over a well to production via the system 100 is shown. The method 300 is provided by way of example, as there are a variety of ways to carry out the method. The method 300 described herein can be carried out using the configurations and examples illustrated in the figures, for example, and various elements of these figures are referenced in explaining the method 300. Each block shown in FIG. 21 represents one or more processes, methods, or subroutines, carried out in the method 300. Furthermore, the illustrated order of blocks is illustrative only and the order of the blocks can change according to the present disclosure. Additional blocks may be added, or fewer blocks may be utilized, without deviating from the scope of the present disclosure. The method 300 can begin at block 302.

Figure 2:
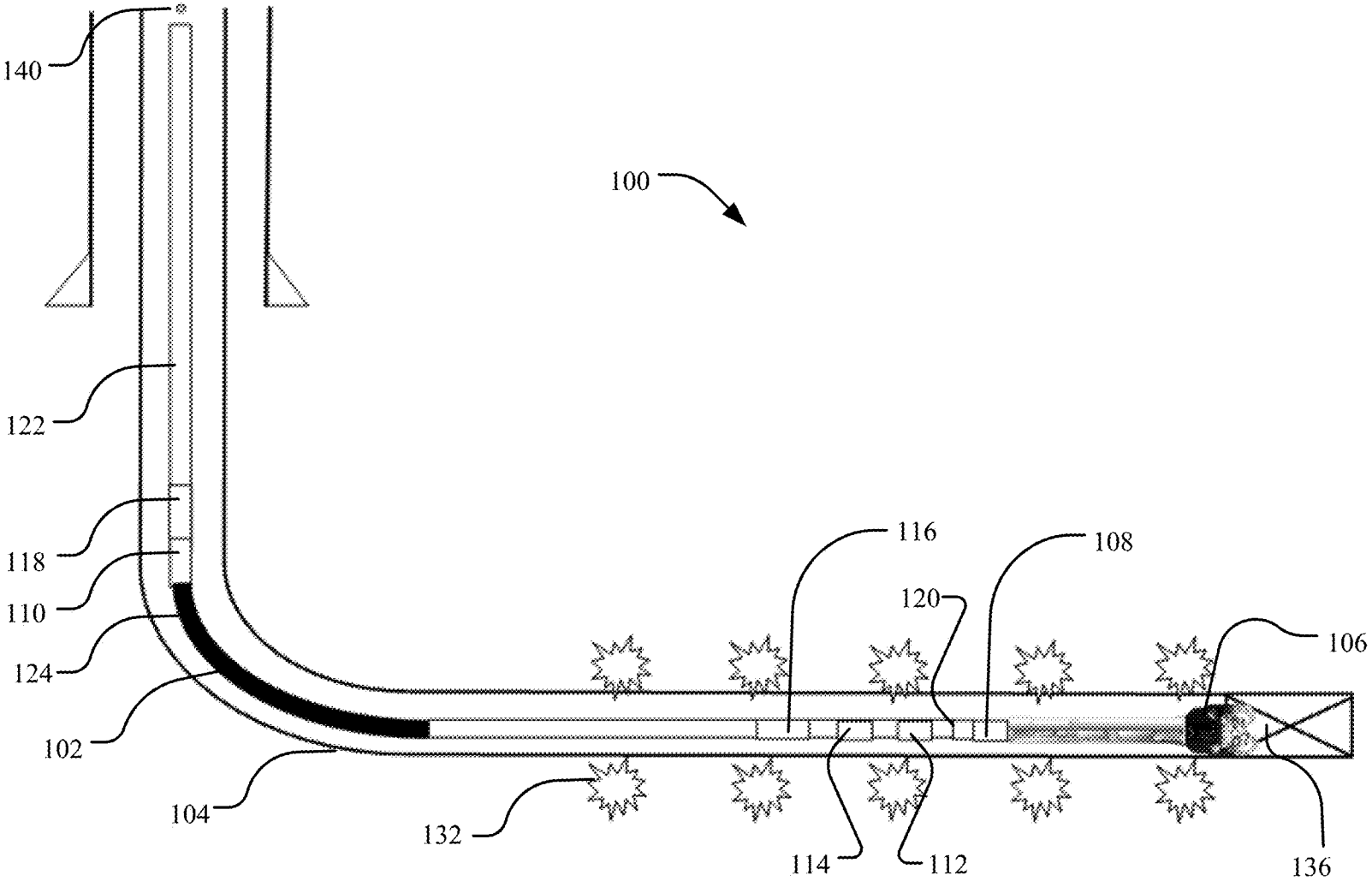
FIG. 2 is a diagram illustrating an example system with a drillstring in a drilling mode after a drilling operation has been performed on a wellbore to clean out the wellbore.

At block 302, the wellbore 104 is drilled, e.g., via the drillstring 102. At block 304, the wellbore 104 is cased using known methods. For example, a large-diameter pipe is lowered into an openhole of the wellbore 104 and cemented in place. At 306, the reservoir is fracture stimulated through perforation clusters 132. At block 308, the drillstring 102 is used to clean out the wellbore 104 to plug back total depth, when the drillstring 102 is in drill mode, as illustrated in FIGS. 1 and 2. During this step, frac 134 and kill 136 plugs are drilled out.

Figure 3:
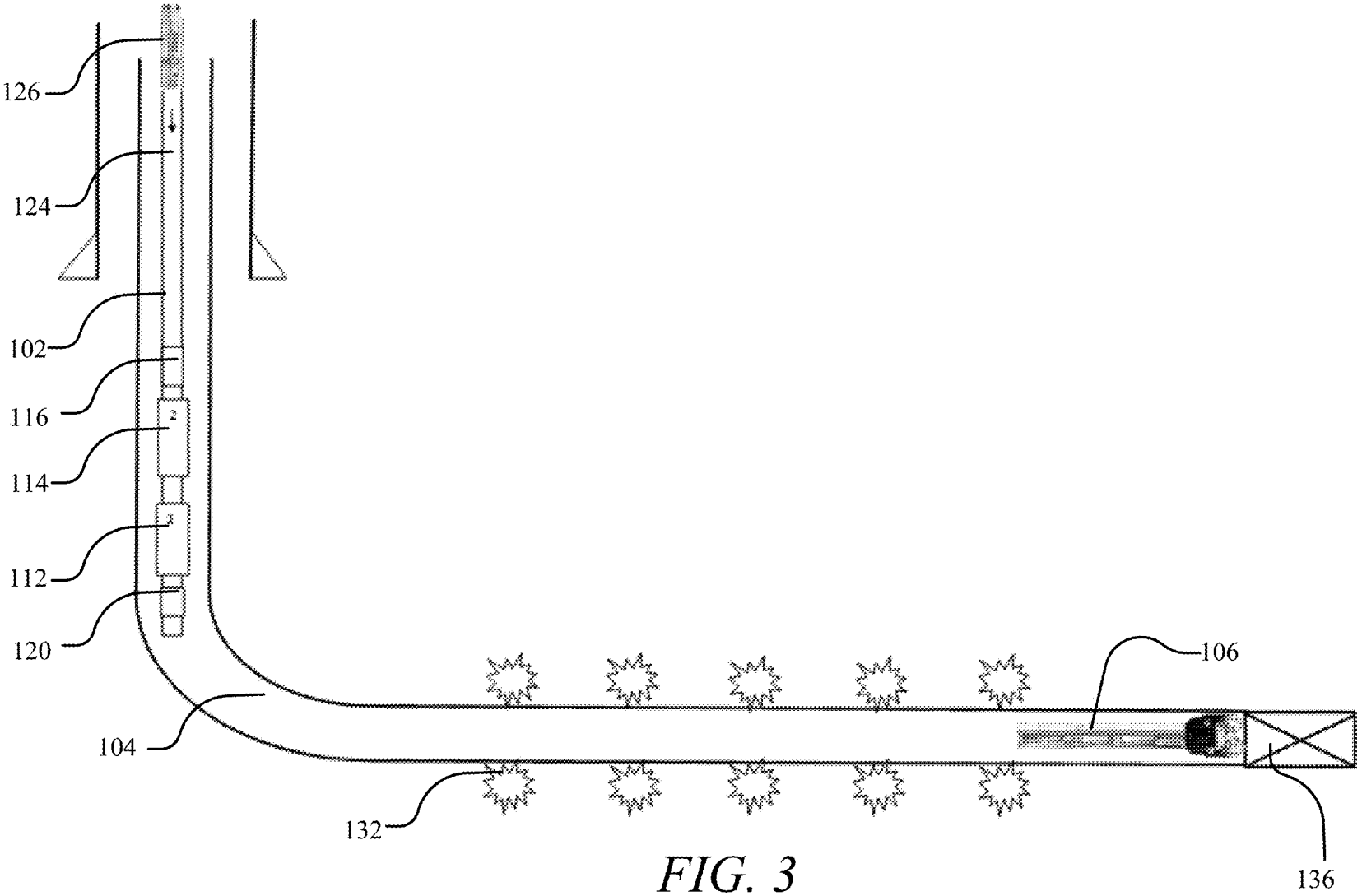
FIG. 3 is a diagram illustrating an example system with a drillstring being converted from a drilling mode to a production mode.
Figure 4:
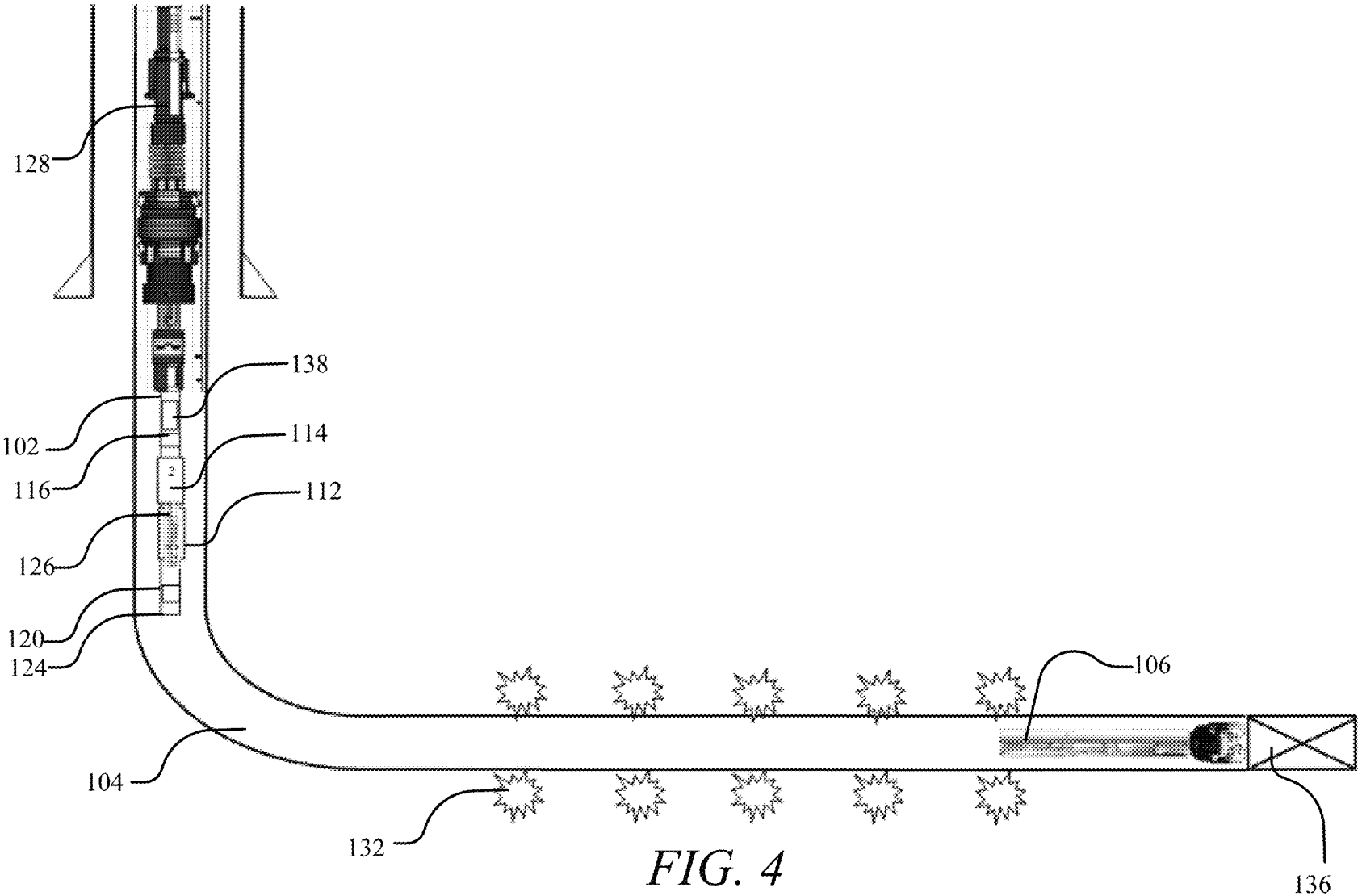
FIG. 4 is a diagram illustrating an example system with a drillstring being converted from a drilling mode to a production mode.

At block 310, the drillstring 102 is converted from a drilling mode to a production mode. This step includes disconnecting the BHA 106 using, for example, the drop ball 140, deploying the reverse flow check and orifice valve 126 to the first gas injection control nipple 112 (as illustrated in FIGS. 2 and 3), and removing a portion of the drillstring 102 from the wellbore 104. The portion includes one or more of the workstring 122, the first 108 and second 110 crossovers, and the second profile nipple 118. In one implementation, where the wellbore 104 includes vertical and horizontal portions, the telescoping swivel joint 138 is deployed to an area that the wellbore 104 is transitioning from the vertical portion to the horizontal portion, as illustrated in FIGS. 5 and 7. According to an implementation, as illustrated in FIGS. 4 and 5, the step of converting the drillstring from a drilling mode to a production mode further includes deploying the packer and crossover tool 128. According to an alternate implementation, as illustrated in FIGS. 6 and 7, the step of converting the drillstring from a drilling mode to a production mode further includes deploying the one or more gas lift mandrels 130.

At block 312, the wellbore 104 is completed and ready to be turned over to production. In other words, this step is the final step when custody of well is transferred to production.

Such a method is more efficient and cost-effective compared to conventional methods. It will be appreciated by those skilled in the art that changes could be made to the implementations described above without deviating from the scope of the present disclosure. For instance, it is foreseen that any one or more of the blocks and/or description of the method 300 may be interchangeable, omitted therefrom, and/or added thereto, without deviating from the scope of the present disclosure. It is understood, therefore, that the present disclosure herein is not limited to the particular implementations disclosed and is intended to cover modifications within the spirit and scope of the present disclosure.

The disclosures shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the implementations described above may be modified within the scope of the appended claims.

What is claimed is:

1. A method for turning a well over to production, the method comprising:

drilling a wellbore using a drillstring;

casing the wellbore;

fracture stimulating a reservoir via the wellbore;

after fracture stimulating, drilling the wellbore to a plug back total depth using the drillstring; and after drilling the wellbore to the plug back total depth, converting the drillstring from a drilling mode to a production mode without removing the entirety of the drillstring from the wellbore, wherein when the drillstring is in the drilling mode, the drillstring includes one or more of a drillout bottomhole assembly, first and second gas injection control nipples, first and second profile nipples, a backpressure valve, a workstring, and first and second crossovers, and wherein converting the drillstring includes: disconnecting the drillout bottomhole assembly; deploying a reverse flow check and orifice valve to the first gas injection control nipple; and removing a portion of the drillstring from the wellbore.

2. The method of claim 1, wherein drilling the wellbore to a plug back total depth includes drilling out frac plugs.

3. The method of claim 1, wherein the portion includes one or more of the workstring, the first and second crossovers, and one of the first and second profile nipples.

4. The method of claim 1, wherein converting the drillstring from a drilling mode to a production mode further includes:

deploying a packer and crossover tool.

5. The method of claim 4, wherein converting the drillstring from a drilling mode to a production mode further includes:

deploying a telescoping swivel joint into the wellbore.

6. The method of claim 4, wherein the packer and crossover tool includes a bypass access mandrel assembly, an on-off tool, a packer, a slotted nipple, a smooth bore seat nipple assembly, and a pup joint.

7. The method of claim 1, wherein converting the drillstring from a drilling mode to a production mode further includes:

deploying one or more gas lift mandrels.

8. The method of claim 7, wherein converting the drillstring from a drilling mode to a production mode further includes:

deploying a telescoping swivel joint into the wellbore.

* * * * *